US008043060B1

(12) United States Patent
Liang

(10) Patent No.: US 8,043,060 B1
(45) Date of Patent: Oct. 25, 2011

(54) TURBINE BLADE WITH TRAILING EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 13/154,506

(22) Filed: Jun. 7, 2011

Related U.S. Application Data

(62) Division of application No. 12/335,410, filed on Dec. 15, 2008, now Pat. No. 7,980,821.

(51) Int. Cl.
*F01D 5/06* (2006.01)

(52) U.S. Cl. ..... 416/97 R; 416/1; 416/96 R

(58) Field of Classification Search ..... 416/96 R, 416/97 R

See application file for complete search history.

(56) References Cited

U.S. PATENT DOCUMENTS

| | | | | |
|---|---|---|---|---|
| 4,229,140 | A * | 10/1980 | Scott | 416/97 R |
| 6,102,658 | A * | 8/2000 | Kvasnak et al. | 416/97 R |
| 6,422,819 | B1 * | 7/2002 | Tsai et al. | 416/97 R |
| 2002/0172596 | A1 * | 11/2002 | Kohli et al. | 416/1 |
| 2005/0111979 | A1 * | 5/2005 | Liang | 416/97 R |
| 2006/0073017 | A1 * | 4/2006 | Manning et al. | 416/97 R |

* cited by examiner

*Primary Examiner* — Kiesha Bryant
*Assistant Examiner* — Mark Tornow
(74) *Attorney, Agent, or Firm* — John Ryznic

(57) ABSTRACT

A turbine rotor blade with a trailing edge cooling circuit in which cooling air from an impingement cavity located adjacent to the trailing edge region is connected to a plurality of metering channels that open onto the pressure side wall of the trailing edge region of the airfoil to discharge the cooling air. A row of submerged slots that open onto the suction side wall of the airfoil are connected to the metering channels by a row of small holes that bleed off the cooling air in the metering channel in a progressive manner and discharge the air into the slot. The trailing edge cooling circuit allows for a thinner trailing edge airfoil, reduces the metal temperature and reduces the shear mixing between the cooling air and the mainstream hot gas flow.

5 Claims, 3 Drawing Sheets

TURBINE BLADE WITH TRAILING EDGE COOLING

CROSS-REFERENCE TO RELATED APPLICATIONS

This application is a DIVISIONAL application of U.S. patent application Ser. No. 12/335,410 filed on Dec. 15, 2008 and entitled TURBINE BLADE WITH TRAILING EDGE COOLING.

FEDERAL RESEARCH STATEMENT

None.

BACKGROUND OF THE INVENTION

1. Field of the Invention

The present invention relates generally to an air cooled turbine blade, and more specifically to trailing edge cooling of a turbine blade.

2. Description of the Related Art Including Information Disclosed Under 37 CFR 1.97 and 1.98

In a gas turbine engine, turbine blades used in the turbine section require internal cooling to allow for higher turbine inlet temperatures that increase the efficiency of the engine. The turbine blades include a trailing edge with cooling holes that provide cooling for this region of the airfoil. in the prior art, channel flow cooling is improved with the use of pin fins or multiple impingement holes in series with a trailing edge camber line discharge to provide improved cooling capability.

FIG. 1 shows a prior art turbine blade with a trailing edge cooling circuit for a first stage turbine blade, which is exposed to the highest gas flow temperature of the blades in the turbine. The blade in FIG. 1 includes pin fins in the trailing edge cooling channel that connects a metering hole to the exit holes spaced along the trailing edge of the airfoil. Using this type of trailing edge cooling design requires a thicker trailing edge to accommodate the trailing edge cooling channel with the pin fins extending between the pressure side wall and the suction side wall. Since the side walls in the trailing edge region require a minimum thickness to provide a rigid structure of the airfoil at the trailing edge. In some turbine stage blades, this large trailing edge thickness may induce high blockage and thus reduce the stage performance.

Because of the size and space limitations, the trailing edge region of a gas turbine airfoil becomes one of the most difficult areas in the engine to cool. For a high temperature turbine airfoil cooling application, extensive trailing edge cooling is required. FIG. 2 shows another prior art first stage turbine blade with trailing edge cooling passages that makes use of a pressure side bleed for the airfoil trailing edge cooling. This type of cooling design to minimize the airfoil trailing edge thickness has been used in the airfoil trailing edge cooling for the last thirty years. Shortfalls associated with this design are the shear mixing between the cooling air and the mainstream flow as the cooling air exits from the pressure side. The shear mixing of cooling air with the mainstream flow reduces the cooling effectiveness for the trailing edge overhang and, thus, reduces the over-temperature at the airfoil trailing edge suction side location. Frequently, this over-temperature location becomes the life limiting location for the entire turbine airfoil.

BRIEF SUMMARY OF THE INVENTION

It is an object of the present invention to provide for a turbine blade with a reduced trailing edge metal temperature over the cited prior art references.

It is another object of the present invention to provide for a turbine blade with a trailing edge cooling passage that will have reduced cooling flow requirement over the cited prior art references.

It is another object of the present invention to provide for a turbine blade with a trailing edge cooling passage that will reduce the shear mixing effect between the cooling air and the mainstream hot gas flow.

It is another object of the present invention to provide for a turbine blade with a trailing edge cooling passage that will provide for an improvement in the turbine stage performance and for improved component life.

DETAILED DESCRIPTION OF THE INVENTION

Figure 1:
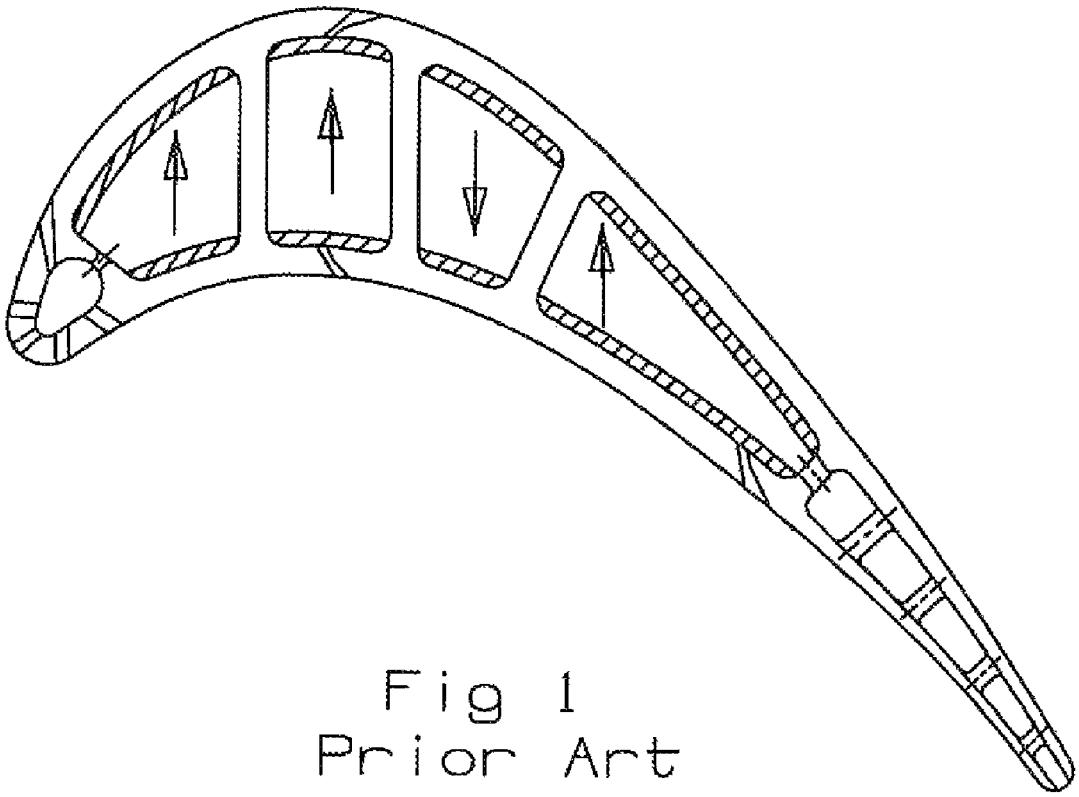
Fig 1 Prior Art
FIG. 1 shows a prior art turbine blade with a cooling circuit for the trailing edge that uses pin fins extending across the trailing edge cooling channel.
Figure 2:
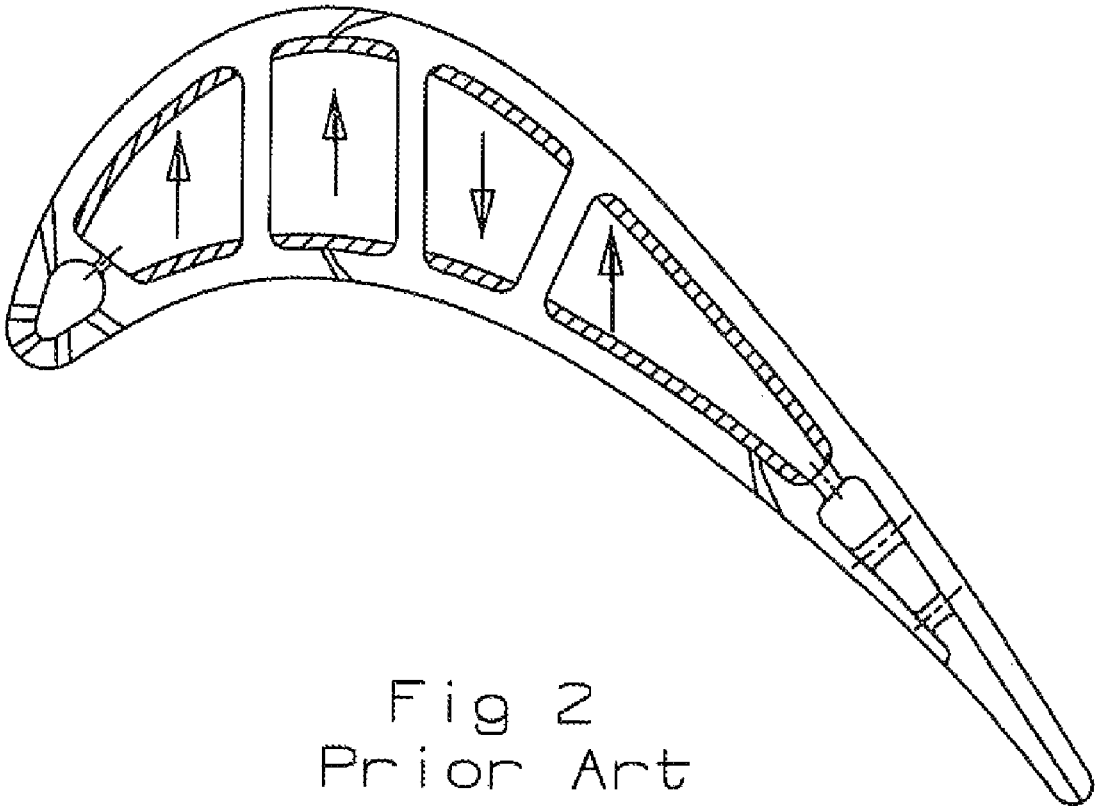
Fig 2 Prior Art
FIG. 2 shows a prior art turbine blade with a cooling circuit for the trailing edge that uses a pressure side bleed slots.

The trailing edge cooling circuit of the present invention is a turbine airfoil with a trailing edge cooling circuit that allows for improved cooling of the trailing edge region over the cited prior art references, reduced shear mixing of the cooling air with the mainstream hot gas flow, and a thinner trailing edge to reduce blockage of the mainstream hot gas flow to improve the turbine stage performance and component life. The trailing edge cooling circuit is shown in FIG. 3 with a pressure side 15 and a suction side 16 and includes a metering channel connected to an impingement cavity 12 formed within the airfoil, a pressure side bleed slot 13 with a short break-out that opens onto the pressure side surface of the airfoil on the trailing edge region, a submerged slot 17 on the suction side of the trailing edge region that extends from a location just aft of the impingement cavity 12 to the end of the trailing edge as seen in FIG. 3, and a row of small holes 18 that connect the metering channel 11 to the submerged slot 17. the small holes 18 are slanted in the direction of the cooling air flow through the holes such that the inlet end is forward from the outlet end.

The impingement cavity 12 can be a first impingement cavity in the airfoil, a second impingement cavity or even a third impingement cavity. The impingement cavity 12 can be a single cavity extending the length of the airfoil, or it can be one of a plurality of segmented impingement cavities extending together the entire length of the airfoil. The submerged slots have a half-circular cross sectional shape as seen in FIG. 4 so that a number of submerged slots 17 are formed along the suction side wall of the trailing edge in which each submerged slot 17 is connected to a row of holes 18 (6 holes per slot 17 in the FIG. 3 embodiment). In this embodiment, one submerged slot 17 is connected to one metering channel 11 through a row of small holes 18. However, in other embodiments one metering channel 11 could be connected to two or more separate submerged slots 17. The entire airfoil suction side wall on the trailing edge includes the submerged slots 17 extending the length of the airfoil. Also, the bleed slots 13 extend the entire length of the airfoil on the pressure side wall. The turbine blade with the trailing edge cooling circuit of the present invention can all be cast as a single piece using the prior art investment casting process. However, some parts such as the small holes 18 can be formed in the airfoil after the casting process using such prior art processes like EDM or laser drilling of the holes. Small hole features are particularly difficult to cast into a part because of the ceramic cores being so brittle and fragile.

In order to reduce the shear mixing between the cooling exit flow versus the main stream hot gas, a reduction of the pressure side cut back distance and also utilizes of submerged cooling slots 17 along the airfoil trailing edge suction side 16 is created in the current invention to provide the proper cooling for the airfoil trailing edge region. The inner surface for the pressure side bleed slot 13 is curved toward the airfoil pressure surface. As a result it reduces the cut back distance for the pressure side bleed slot 13 and improves the film cooling effectiveness level for the pressure side slot cooling. However this will leave a longer un-cooled airfoil suction side wall. As a result, submerged cooling slots 17 with multi-hole film cooling from the row of small holes 18 are incorporated on the suction surface of the airfoil trailing edge opposite to the pressure side bleed cooling channel. These submerged cooling slots 17 comprise of a cooling air multiple small holes 18, which is connected to the pressure side bleed cooling channel 11. The submerged cooling slot 17 provides additional convective surface area for the suction side trailing edge wall and also provides proper cooling flow spacing for the discharge cooling air and minimize shear mixing between the discharge cooling air and hot flow gas for the airfoil suction side trailing edge.

Figure 3:
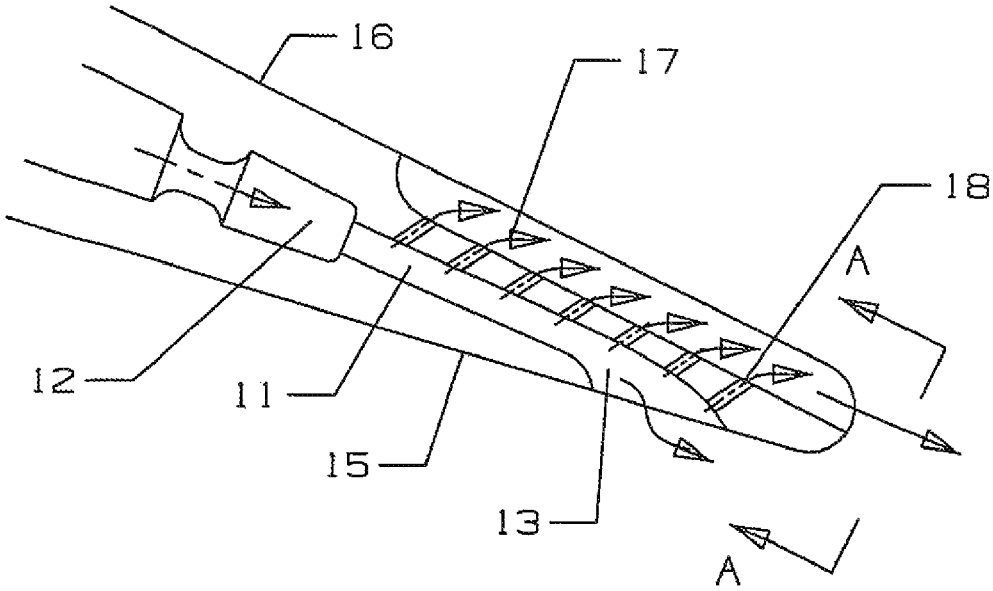
FIG. 3 shows the trailing edge cooling circuit of the present invention.
Figure 4:
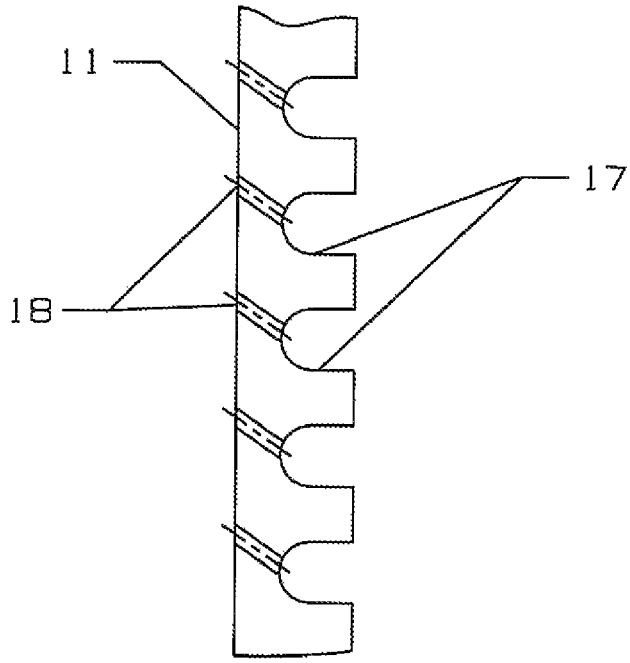
FIG. 4 shows a cross sectional rear view of the trailing edge cooling circuit of FIG. 3.

In the FIG. 3 airfoil trailing edge cooling design with multiple cooling concept, cooling air is provided by the first up-pass channel of the serpentine cooling flow circuit. The airfoil trailing edge is cooled with double impingement cooling for the upper portion of the airfoil trailing edge in conjunction with multiple hole cooling for the airfoil suction side and pressure side bleed at trailing edge exit. FIG. 3 shows the detailed view of the airfoil trailing edge multiple cooling technique configurations. Cooling air for the trailing edge exit section is metered at the entrance section of the pressure side bleed slots 11 to closely match the hot gas flow conditions prior discharging from the pressure side slots 13. In addition, portion of the cooling air is bled off from the pressure side cooling channels 11 into the suction side submerged slots 17 through the multiple small holes 18. As the cooling flow entering into the submerged cooling slot 17 at the mainstream interface location, the spacing provided by the submerge slots 17 allow the cooling air forming a concurrent flow with the mainstream. As a result it minimizes the shear mixing between the cooling bleed air and mainstream flow. Thus prolong the cooling air stay within the slot and enhanced the cooling effectiveness for the airfoil trailing edge. In addition the submerged cooling slots also reduce the effective trailing edge thickness as well as reduce the aerodynamic blockage loss.

Major design advantages of this cooling scheme over the current blade trialing edge camber line discharge and pressure side bleed cooling designs are enumerated below.

Multiple bleed slot cooling concept reduces the airfoil trailing edge thickness thus reduce the airfoil base region heat load by means of minimizing the vortex formation and hot gas side surface at the blade base region. This translates to a reduction of airfoil trailing edge metal temperature and improves airfoil life.

The multiple bleed slots reduce the effective airfoil trailing edge thickness which translate to the reduction of airfoil blockage and minimize the stage pressure losses. Subsequently, it improves the turbine stage performance.

The suction side submerged cooling slots provide additional convection cooling for the airfoil trailing edge suction surface. Thus minimize the hot spot life limiting location for the airfoil.

The suction side submerged slots with increase slot dept allow cooling air diffuse within the cooling slots which lower the cooling air velocity and yields a good down stream film effectiveness. In addition it minimizes shear mixing thus lower the aerodynamic loss and maintain high film cooling effectiveness for the airfoil trailing edge suction surface.

This particular trailing edge cooling construction concept produces a very short pressure side cut back thus minimize shear mixing and increase film effectiveness level. This translates to lower film temperature and trailing edge corner metal temperature.

The multiple cooling construction technique can be used in a cooling design to accommodate the thin airfoil trailing edge geometry.

Multi-row of cooling air bleed holes is built-in on the airfoil suction side trailing edge region as well as the curved surface at the exit of the pressure side bleed slots. This particular cooling air suction hole will reduced the boundary layer thickness for the pressure side exit slot thus achieve a better pressure side exit film for the pressure side bleed slot.

Multiple trailing edge cooling technique provide more effective airfoil trailing edge cooling and lower the trailing edge metal temperature level as well as through wall gradient. As a result it eliminates the airfoil suction side over temperature problem and yields higher stress rupture life and LCF life for the airfoil.

I claim the following:

1. A process for cooling a trailing edge region of a turbine rotor blade, the turbine rotor blade having an impingement cavity located adjacent to the trailing edge region of the airfoil of the blade to supply cooling air, the process comprising:

metering cooling air from the impingement cavity along the trailing edge region of the airfoil;

bleeding off a portion of the metering cooling air through a plurality of holes and discharging the air along a slot extending along the suction side wall of the trailing edge region; and, discharging the remaining metering air out onto the pressure side wall of the trailing edge region of the airfoil.

2. The process for cooling a trailing edge region of claim 1, and further comprising the step of:

progressively bleeding off the metering air and into the suction side slot as the metering air flows down the trailing edge region of the airfoil.

3. The process for cooling a trailing edge region of claim 2, and further comprising the step of:

bleeding off the metering air along the length of the trailing edge region of the airfoil.

4. The process for cooling a trailing edge region of claim 2, and further comprising the step of:

metering the cooling air from the impingement cavity and bleeding off a portion of the metering air along the entire airfoil length in the spanwise direction.

5. The process for cooling a trailing edge region of claim 4, and further comprising the step of:

associating each suction side slot with a separate metering channel.

* * * * *